US006471543B1

(12) United States Patent
Balcombe et al.

(10) Patent No.: US 6,471,543 B1
(45) Date of Patent: Oct. 29, 2002

(54) ELECTRICAL CONNECTORS

(75) Inventors: David Balcombe; John Boocock, both of Stevenage (GB)

(73) Assignee: Matra BAe Dynamics (UK) Limited, Hertfordshire (GB)

( * ) Notice: Subject to any disclaimer, the term of this patent is extended or adjusted under 35 U.S.C. 154(b) by 766 days.

(21) Appl. No.: 08/842,650

(22) Filed: Apr. 15, 1997

(30) Foreign Application Priority Data

Apr. 16, 1996 (GB) ..... 9607857

(51) Int. Cl.[7] ..... H01R 13/73

(52) U.S. Cl. ..... 439/565; 439/362; 439/573; 439/550

(58) Field of Search ..... 439/565, 562, 439/564, 550, 573, 572; 403/327, DIG. 7; 24/671, 674, 676

(56) References Cited

U.S. PATENT DOCUMENTS 3,793,613 A * 2/1974 Reichert ..... 439/565
5,105,339 A * 4/1992 Olsson et al. ..... 439/565
5,228,865 A * 7/1993 Douty et al. ..... 439/565
5,288,244 A * 2/1994 Lien ..... 439/564
5,584,726 A * 12/1996 Le Gallic et al. ..... 439/573

FOREIGN PATENT DOCUMENTS

| | | |
|---|---|---|
| GB | 576581 | 4/1946 |
| GB | 984042 | 2/1965 |
| GB | 1 530 917 | 11/1978 |
| WO | WO 93/24974 | 12/1993 |

* cited by examiner

*Primary Examiner*—Tho D. Ta
(74) *Attorney, Agent, or Firm*—Nixon & Vanderhye P.C.

(57) ABSTRACT

A connector (6) includes a device (11) for securing it to a bulkhead or panel (14) of an enclosure. The device comprises a steel retaining clip (11) which is pushed over each jackpost (9) of the connector (6) and engages in a slot (10). the clip retains the connector (6) against the bulkhead (14) while a mating connector is attached, without the need for any nut and bolt arrangement or bulkhead fixing screws.

13 Claims, 3 Drawing Sheets

ELECTRICAL CONNECTORS

BACKGROUND OF THE INVENTION

1. Field of the Invention

This invention relates to improvements in electrical connectors of the type shown in FIG. 1 and sometimes known as "MDM" or "D microminiature" connectors.

2. Discussion of Prior Art

The known connector type 1 of FIG. 1 is provided with two or more rows of sockets or pins 2 which, on the reverse side are provided with contacts for soldering to pads on a printed circuit board or onto flying leads, for example. Two jackposts 3 with internal screw-threads are provided for securing a mating connector thereto.

The pine 2 and jackposts 3 are usually inserted through a cut-out in a bulkhead and the entire connector is fastened to the bulkhead by screws which are located in holes 4 provided in end flanges 5.

The mating connector is usually attached to a cableform and carries two jackscrews which screw into the jackposts 3, thereby holding the two connectors together.

In cases where space is limited it is not always possible to secure the connector 1 to the bulkhead by screws (or nuts and bolts). For instance, there may not be enough space on the bulkhead to accommodate any necessary holes, or there may be so little space behind the connector that the installation is impossible or very difficult.

In other applications where the connector 1 is attached to a printed circuit board via a flexible printed circuit board or flying leads, there is a need for a means of supporting the connector against a bulkhead while a mating connector is being secured thereto.

SUMMARY OF THE INVENTION

This invention aims to provide a means for supporting a connector while a cableform is being mated, without the need for bulkhead screws or bolts.

Accordingly, an electrical connector for mounting within a bulkhead comprises a chassis and a retaining clip, the chassis carrying electrical connection means and at least one jackpost for engagement with a co-operating part of a mating connector, in which the jackpost incorporates a slot for receiving the retaining clip which, in use, rests on an edge of the bulkhead.

In one embodiment the slot in the jackpost is a tangential slot and the retaining clip is substantially U-shaped.

In an alternative embodiment, the slot in the jackpost comprises a circular groove and the retaining clip is ring-shaped.

The retaining clips may preferably be made of spring steel, stainless steel or beryllium copper and can conveniently be made by either a photo-etching or pressing process.

BRIEF DESCRIPTION OF THE DRAWINGS

Some embodiments of the invention will now be described, by way of example only with reference to the drawings of which.

DETAILED DESCRIPTION OF PREFERRED EMBODIMENTS

Figure 1:
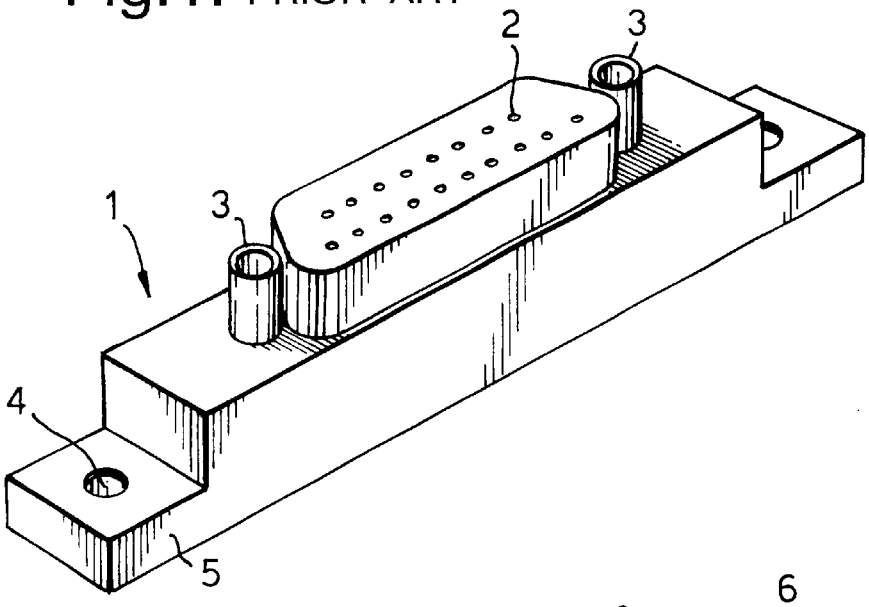
Fig.1. PRIOR ART
FIG. 1 is a perspective view of a MDM known connector.
Figure 2:
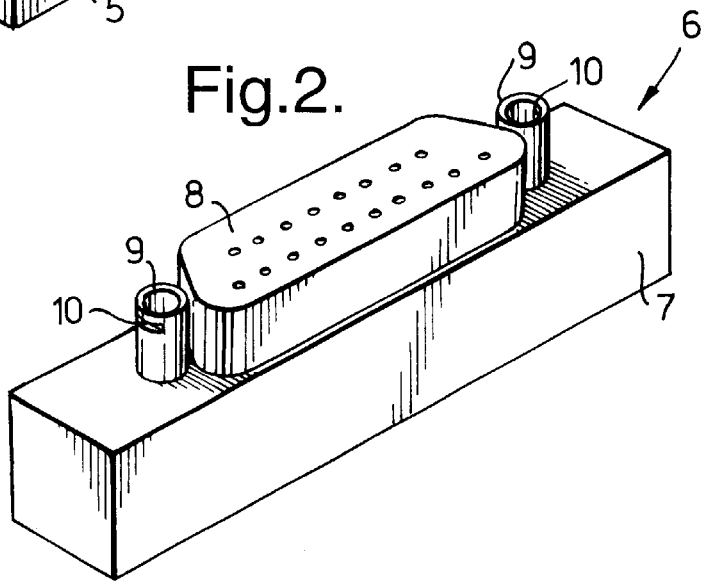
FIG. 2 is a perspective view of a MDM connector of the type shown in FIG. 1 but modified in accordance with a first embodiment of the invention.

Referring to FIG. 2, the MDM-type connector 6 shown here comprises a chassis 7 which carries two rows of electrical sockets 8 and two jackposts 9, these being the features in common with the standard connector of FIG. 1. In contrast with the standard connector, the jackposts 9 of the device of FIG. 2 each incorporate a tangential slot 10. The slot is cut in the lead-in portion of each jackpost 9 rather than the threaded portion in order to maintain mechanical integrity.

Figure 3:
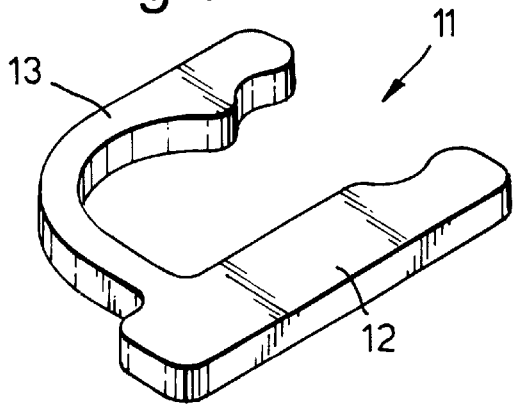
FIG. 3 is a perspective view of a first type of retaining clip.

The purpose of each slot 10 is to receive a retaining clip 11 as shown in FIG. 3. In this example, the clip 11 is etched from stainless steel and is substantially U-shaped. One arm 12 of the U-shape (which is straight) engages in the slot 10 with its outer surface protruding from the slot 10 sufficiently to engage with an edge of or recess in a bulkhead. The other arm 13 of the U is curved to follow the contours of the jackpost 9. The clips 11 are thin compared with the height of the jackposts 9.

Figure 4:
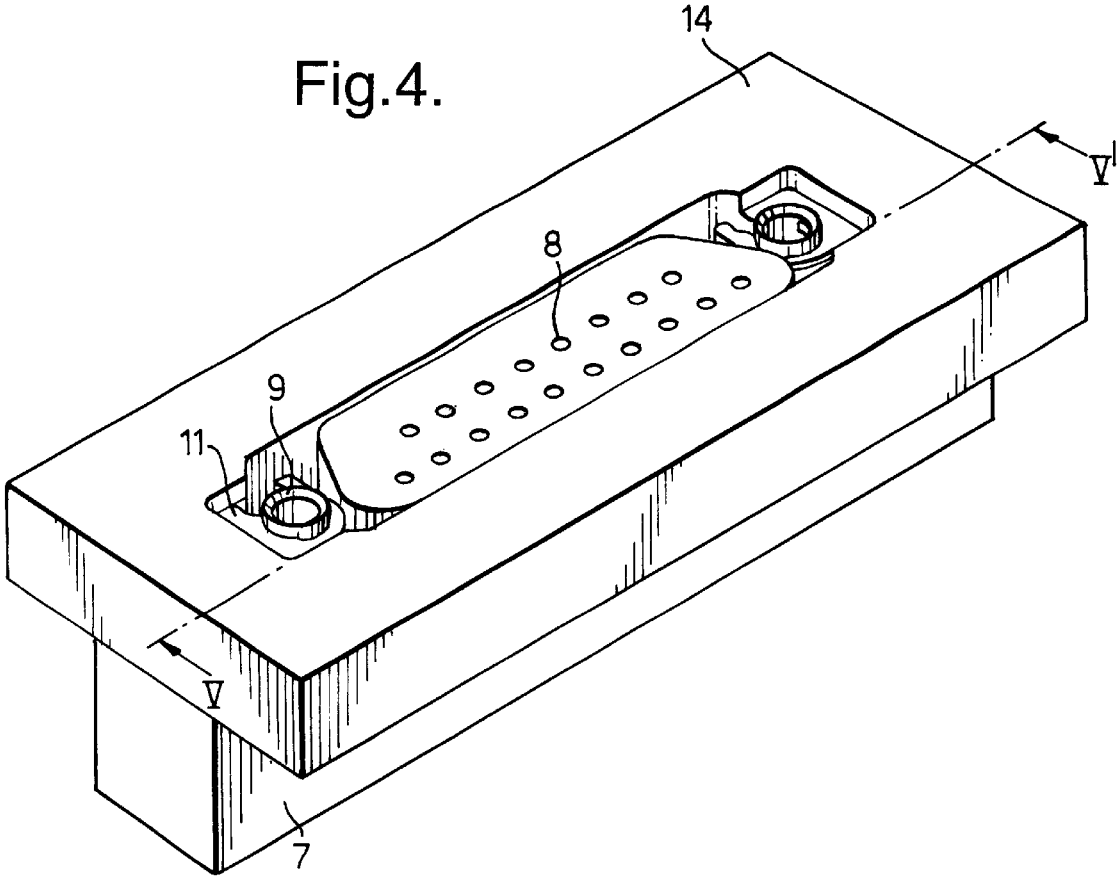
FIG. 4 is a perspective view of the connector of FIG. 2 assembled in a bulkhead.
Figure 5:
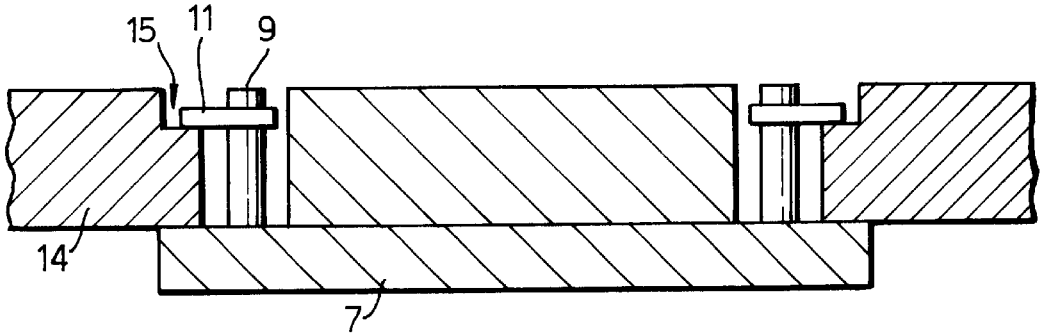
FIG. 5 is a cross-sectional view along a line V–V[1] of FIG. 4.

FIGS. 4 and 5 show the connector 6 located in a cut-out in a bulkhead or panel 14. The jackposts 9 and the part of the connector which carries the sockets 8 protrude through the bulkhead 14 with the extremities of the connector chassis 7 abutting the bulkhead 14. The retaining clips 11 are shown located in their respective slots 10 with their outer surfaces resting on an edge of a recess 15 formed in the bulkhead 14.

With the retaining clips 11 in place, the connector 6 is now retained in the bulkhead 14 and cannot fall out. Once in place, a mating connector can be secured and screwed into the jackposts 9. Thus there is no need for any screws for securing the chassis 7 to the bulkhead 14, and if desired, the holes 4 and end flanges 5 of the standard connector can be dispensed with.

In an alternative embodiment, the bulkhead 14 is not recessed and the clips 11 rest on the bulkhead's upper surface.

The clips 11 may be located on the jackposts 9 with the assistance of a telescopic tool to be described with reference to FIG. 8. It is necessary to ensure that each clip 11 is passed over the jackpost 9 ie so that the straight arm 12 of the U-shape engages with the slot 10 and with the bulkhead.

The arrangement of the first embodiment described above requires the tangential slot 10 to be positioned at a specific location on the jackpost 9 with respect to the connector 6 (so that the arm 12 of the clip 11 can rest on the bulkhead). This can be achieved by cutting the slot after the jackposts have been assembled into the connector body. However, removal of the ensuing swarf may pose a problem. Alternatively, the slots can be cut before assembly, but then lining up the slotted jackposts to their correct positions within the connector body could be time consuming.

The arrangement of the second embodiment overcomes the above problems by providing a continuous groove in each jackpost, rather than a slot. In this case a ring-shaped clip can be used and can be positioned over the jackpost, either way round, to engage with the groove.

Figure 6:
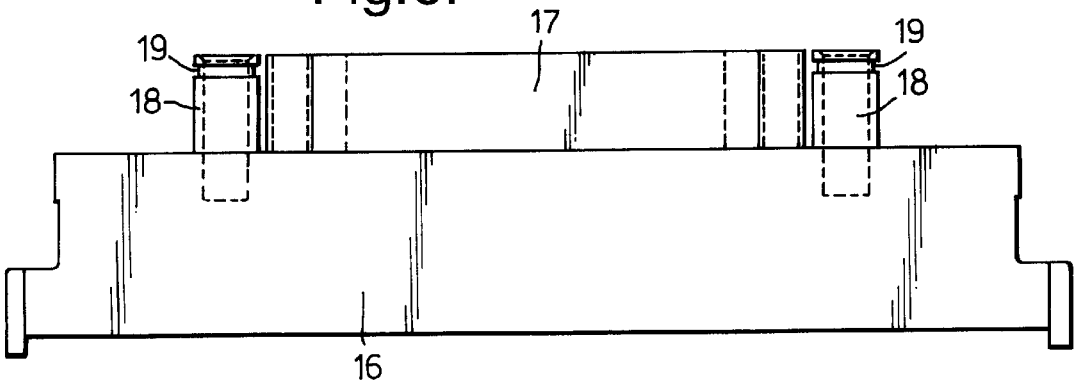
FIG. 6 is a side view of a MDM connector of the type shown in FIG. 1 but modified in accordance with a second embodiment of the invention.

Referring then to FIG. 6, a connector body 16 supports an electrical socket housing 17 and two jackposts 18. Each jackpost 18 incorporates a continuous, circumferential groove 19. Each groove 19 is cut into the lead-in portion of each jackpost 18 rather than the threaded portion, in order to maintain mechanical integrity.

Each groove 19 receives a ring-shaped clip which can be etched from stainless steel for example. An example of a preferred form of clip is shown in FIG. 7.

Figure 7:
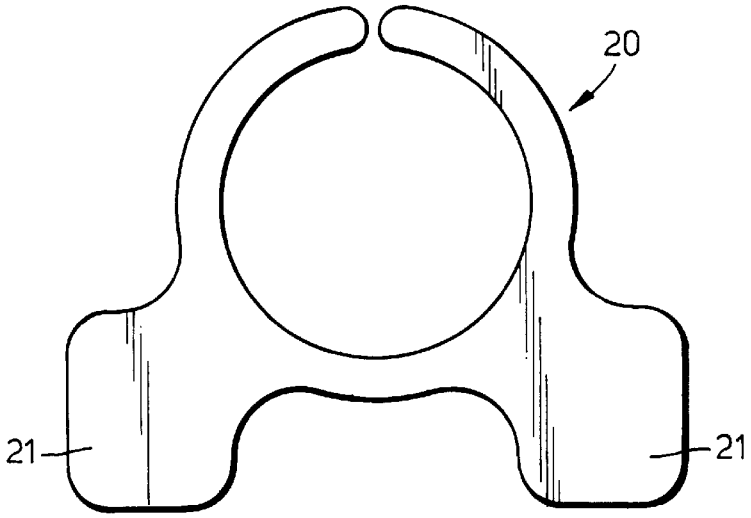
FIG. 7 is a plan view of a second type of retaining clip.

In FIG. 7 a retaining clip 20 is essentially circular and C-shaped, incorporating at least one protuberance for engagement with a bulkhead. The clip 20 of FIG. 7 incorporates two such protuberances in the form of tags 21. The dimensions of the tags 21 depend on the spacing between the jackposts 18 and the bulkhead in which the connector 16 is to be mounted.

The thickness and inner diameter of the clips is chosen so that they fit snugly around the jackpost 18 within the groove 19.

Alternative forms of ring-shaped clip could be elliptical rather than circular and/or dispense with tags and rely on a sufficiently large outer diameter for engagement with a bulkhead. In the case of an elliptical clip, it is preferred that the diameter of the minor axis of the ellipse is the same as the diameter of the grooved portion of the jackpost and that the inner circumference of the clip is slightly greater than the circumference of the uncut portion of the jackpost.

In a similar fashion to the U-shaped clip of FIG. 3, a ring-shaped clip can be located on a jackpost by means of a telescopic tool, now to be described with reference to FIG. 8.

A rod 22, preferably cylindrical, incorporates a flared portion 23 at one of its ends and a locating stub 24, connected to the flared portion for alignment with a jackpost. The rod 22 is arranged to be a sliding fit within the bore of a second cylinder 25.

In use, a clip 11 is manually fitted over the rod 22 and pushed along the length of the rod until it reaches the flared portion 23. The end of the rod 22 distant from the flared portion 23 is inserted into the second cylinder 25 and the locating stub 24 inserted into the bore of a jackpost. The cylinder 25 is then pushed along the rod 22 and it makes contact with the clip 11, continues to push the clip over the flared portion 23, thus causing the clip to expand sufficiently so that it slides over the jackpost. Further movement of the cylinder 25 with respect to the rod 22 will push the clip off the flared portion 23 and over the jackpost until it snaps into the jackpost slot.

Figure 8:
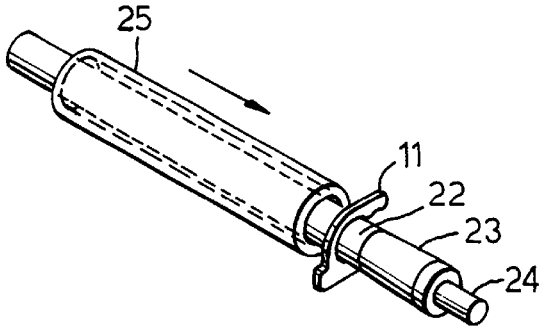
FIG. 8 is a perspective view of an assembly tool for use with the connectors of FIGS. 2 and 6.

The tool of FIG. 8 is preferred over the conventional means comprising the use of pliers for the following reasons. Firstly the clip is not expanded to the same degree, thus leasing the risk of breakage, and secondly, there is less likelihood of the clip springing off the tool and creating an eye hazard, for example.

The tool can be used for fitting retaining clips to a variety of structures, its use not being limited to the example described herein. In certain cases, the locating stub 24 may be superfluous and could therefore be dispensed with.

What is claimed is:

1. An electrical connector for mounting within a bulkhead, said electrical connector comprising:

a chassis; and a retaining clip, said chassis carrying electrical connection means and at least one jackpost for engagement with a co-operating part of a mating connector, said jackpost having a slot therein for receiving the retaining clip which, in use, rests on an edge of the bulkhead.

2. An electrical connector according to claim 1 in which said slot is a tangential slot and said retaining clip is substantially U-shaped.

3. An electrical connector according to claim 1 in which said retaining clip is made of beryllium copper.

4. An electrical connector according to claim 1 in which the retaining clip is made of spring steel.

5. An electrical connector according to claim 1 in which the retaining clip is made of stainless steel.

6. An electrical connector according to claim 1 in which the retaining clip is made by a photo etching process.

7. An electrical connector according to claim 1 in which the retaining clip is made by a pressing process.

8. An electrical connector according to claim 1 in which said slot comprises a circular groove and said retaining clip is ring-shaped.

9. An electrical connector according to claim 8 in which said retaining clip is C-shaped and incorporates a protuberance for engagement with a bulkhead.

10. An electrical connector according to claim 8 in which said retaining clip is elliptical.

11. An electrical connector capable of being mounted within a bulkhead, said electrical connector comprising:

a chassis, said chassis carrying electrical connection means;

at least one jackpost for engagement with a cooperating portion of a mating connector, and at least one retaining clip, said jackpost having a slot therein for receiving said retaining clip which, when located in said slot, rests on an edge of said bulkhead and retains said electrical connector in position on said bulkhead.

12. An electrical connector according to claim 11, wherein said at least one jackpost comprises a cylindrical jackpost and said slot comprises a circular groove and said at least one retaining clip is ring-shaped.

13. An electrical connector according to claim 12, wherein said connector includes at least two jackposts.

* * * * *

UNITED STATES PATENT AND TRADEMARK OFFICE

CERTIFICATE OF CORRECTION

PATENT NO. : 6,471,543 B1
DATED : October 29, 2002
INVENTOR(S) : Balcombe et al.

It is certified that error appears in the above-identified patent and that said Letters Patent is hereby corrected as shown below:

Title page,
Item [*], Notice, patent term extension, "766 days" should read -- 776 days --

Signed and Sealed this

First Day of April, 2003

JAMES E. ROGAN
*Director of the United States Patent and Trademark Office*